US005611414A

United States Patent [19]

Walker

[11] Patent Number: 5,611,414

[45] Date of Patent: Mar. 18, 1997

[54] SELF-CONTAINED FOLDING PORTABLE BED

[76] Inventor: Jeffrey R. Walker, P.O. Box 143, Ballinafad, Ontario, Canada, N0B 1H0

[21] Appl. No.: 421,784

[22] Filed: Apr. 14, 1995

[51] Int. Cl.[6] ..... A47C 17/82; A47C 19/22

[52] U.S. Cl. ..... 190/2; 5/420; 5/722

[58] Field of Search ..... 5/420, 417, 418, 5/419, 465, 2.1, 413; 190/2, 1

[56] References Cited

U.S. PATENT DOCUMENTS

| | | | |
|---|---|---|---|
| 1,805,415 | 5/1931 | Pendarvis et al. | 190/2 |
| 3,083,378 | 4/1963 | Pursell | 5/413 |
| 3,323,151 | 6/1967 | Lerman | 5/420 |
| 3,336,610 | 8/1967 | Geddings | 5/420 |
| 3,846,857 | 11/1974 | Weinstock | 5/465 |
| 4,742,900 | 5/1988 | Boxhammer | 5/620 |

FOREIGN PATENT DOCUMENTS

| | | | |
|---|---|---|---|
| 562409 | 9/1923 | France | 5/465 |
| 761135 | 3/1934 | France | 5/419 |

*Primary Examiner*—Alexander Grosz
*Attorney, Agent, or Firm*—Eugene J. A. Gierczak

[57] ABSTRACT

The invention describes a bed in a suitcase requiring minimal preparation for use. It is intended for storage in, for example, a car or truck, and for use when the driver may not be in a condition to drive home. The bed is formed by mating a foldable mattress or pallet with bed clothing, such as an undersheet with a half-width sleeping bag cover. The foldable mattress has a number of cushioning elements which can be folded, especially when used in conjunction with material hinges, to fit within the suitcase. The cushions may also be extended to lie side by side in an extended position for sleeping. Some or all of those elements may have a hard shell mounted to their undersides to protect the mattress from broken glass or sharp objects. The suitcase and hard shell materials are resistant to water absorption and the bed clothing is removable and washable.

10 Claims, 6 Drawing Sheets

SELF-CONTAINED FOLDING PORTABLE BED

FIELD OF INVENTION

This invention relates to the field of portable beds, and, in particular, to an easily cleaned portable bed which is stored within its own puncture resistant ground covering when not in use.

BACKGROUND ART

Portable bed rolls have been known for many years. When one goes camping one uses a sleeping bag. Although some particularly hardy campers prefer to sleep directly on the ground, it is more common to find some kind of ground covering, such as a tent floor or ground sheet to keep the sleeping bag from absorbing moisture, or to keep the sleeping bag clean. For those who find sleeping on the ground uncomfortable and prefer some cushioning one may easily purchase an expanded foam mat or an air mattress. Many such mats and mattresses are known. However, for any of these one must pack and carry at least three separate items: The sleeping bag, the ground cover, and the cushioning layer.

Further, one does not always have camping equipment available when an unexpected need for a bed arises. For example, one may have a mechanical failure on the highway, and have to spend the night awaiting help. Alternatively, one may have consumed wines, ale, or spirits to such an extent that it may not be prudent to drive home.

In such circumstances it may be desirable to have access to a bed which does not require a high level of concentration or a great deal of time to prepare. It may also be advantageous to have a ground covering that is both resistant to absorption of liquids and resistant to puncture by, for example, broken glass. Air mattresses are particularly poorly suited for use in areas of broken glass, and expanded foams may easily be cut. Repeated cutting of these foams may soon render them unfit for further use.

In U.S. Pat. No. 3,971,495 to Velasquez one finds a combination camper's tent, cot, and pack frame utilizing a tubular frame to which fabric is attached to form a tent. Velasquez refers to the use of a sleeping bag within the tent, but neither discloses in the drawings nor in the text how this is done. Most importantly Velasquez describes a piece of camping equipment that requires assembly and disassembly of the sort which may exceed, at least temporarily, the capabilities of those who may wish to employ the present invention. It is too complex and cumbersome.

Similarly, although U.S. Pat. No. 3,848,279 to Ipsen, Jr., describes a unitary structure comprising a cot, a covering or top, and a foldable mattress, again, this is a piece of camping equipment. It requires at least a modest level of erection of the frame and canopy, and therefore a level of concentration and skill which the present invention seeks to avoid. Furthermore it comprises a bulky, hard external tubular metal frame. Although Ibsen, Jr., refers to storage in car trunks, trucks and boats for transportation, the rigid frame with sharp edged fittings would not be suitable for squeezing behind, or under, a seat or for compressing into a corner. Complicated structure is also found in U.S. Pat. No. 3,730,407 to Russell. U.S. Pat. No. 4,501,362 to Duncan concerns a hinged container for compressing a sleeping bag.

U.S. Pat. No. 3,877,092 to Gaiser and U.S. Pat. No. 4,996,733 to Tsai both disclose integral inflatable mattress and sleeping bag assemblies. Gaiser discloses a resilient porous cellular material within an air tight jacket and a mandrel about which the assembly may be rolled to expel air. Tsai teaches a sleeping bag disposed intermediate upper and lower inflatable longitudinally ribbed air mattresses. While these units are not complicated, they both are vulnerable to punctures, and are not really beds-within-a-container.

Thus there is a need for a self-contained, easily cleaned bed, cushion, and ground cover device suitable for use on a moments' notice by those who may not be disposed to activities requiring intense concentration.

BRIEF DESCRIPTION OF THE INVENTION

The invention described herein is a portable bed in a suitcase. In an aspect of that invention the portable bed in a suitcase comprises a casing that may be opened and closed and a cushioning assembly containable within that casing, the cushioning assembly extensible from a first, stored position within the casing to a second extended position for supporting a reposing body.

In another aspect of the invention there is a self-contained portable bed comprising a casing, a foldable cushioning assembly, and a bed clothing assembly in which the bed clothing assembly is affixed to the foldable cushioning assembly, and the foldable cushioning assembly is affixed within the cover; and the foldable cushioning member is foldable to a first stored position, in which it is enveloped by the external cover, and extensible to a second extended position whereby in that second position one may repose upon the bed.

In an additional aspect of the invention there is a self-contained portable bed as described above in which the external casing comprises at least one puncture resistant layer; and in the extended position the majority of the puncture resistant layer is deployed beneath at least a portion of the foldable cushioning assembly.

BRIEF DESCRIPTION OF DRAWINGS

FIG. 5, being FIG. 5*a* is a developed view of an open casing assembly. FIG. 5*b* is a developed view, from below, of the principle elements of the cushioned bedding assembly of FIG. 4. FIG. 5*c* is a cross sectional view of the bedding assembly of FIG. 5*b* when located upon the casing assembly of FIG. 5*a*.

DETAILED DESCRIPTION OF THE INVENTION

Figure 1:
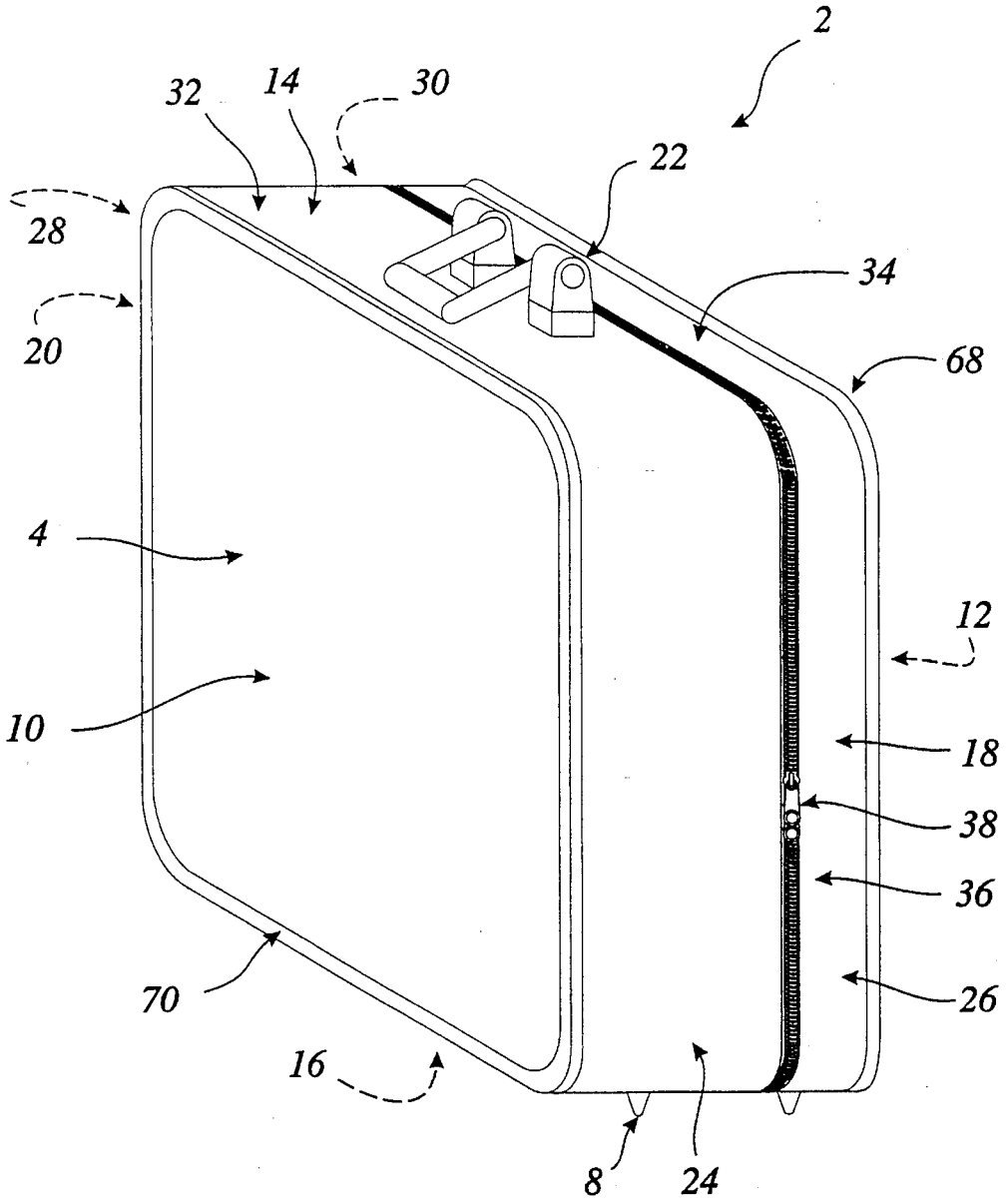
FIG. 1 is a general arrangement of the self-contained folding portable sleeping unit of the invention herein in its folded up form.

Commencing with FIG. 1, a self-contained, portable folding bed, more easily termed a bed in a suitcase, is shown generally as 2. It comprises an external storage cover, or casing 4 appearing in its folded position to be a suitcase, as shown in FIG. 1, and an internally stored ground covering and cushioned bedding assembly shown generally in FIG. 2 as 6. Support feet 8 allow casing 4 to stand upright when not in use.

The external storage cover, or casing 4 comprises a first main panel 10, a second main panel 12, a top face 14, a bottom face 16, a first side face 18, a second side face 20, and a handle 22. First side face 18 comprises a first portion 24 and a second portion 26. Second side face 16 comprises a first portion 28, and a second portion 30. Top face 14 comprises a first portion 32, and a second portion 34. The interface of the first and second portions of the first side, top, and second side faces 18, 14, and 20, is defined by a zipper 36, having a first half **36*a* and a second half 36*b*. At least one zipper car 38 runs along the interleaving track of zipper 36**.

Figure 2:
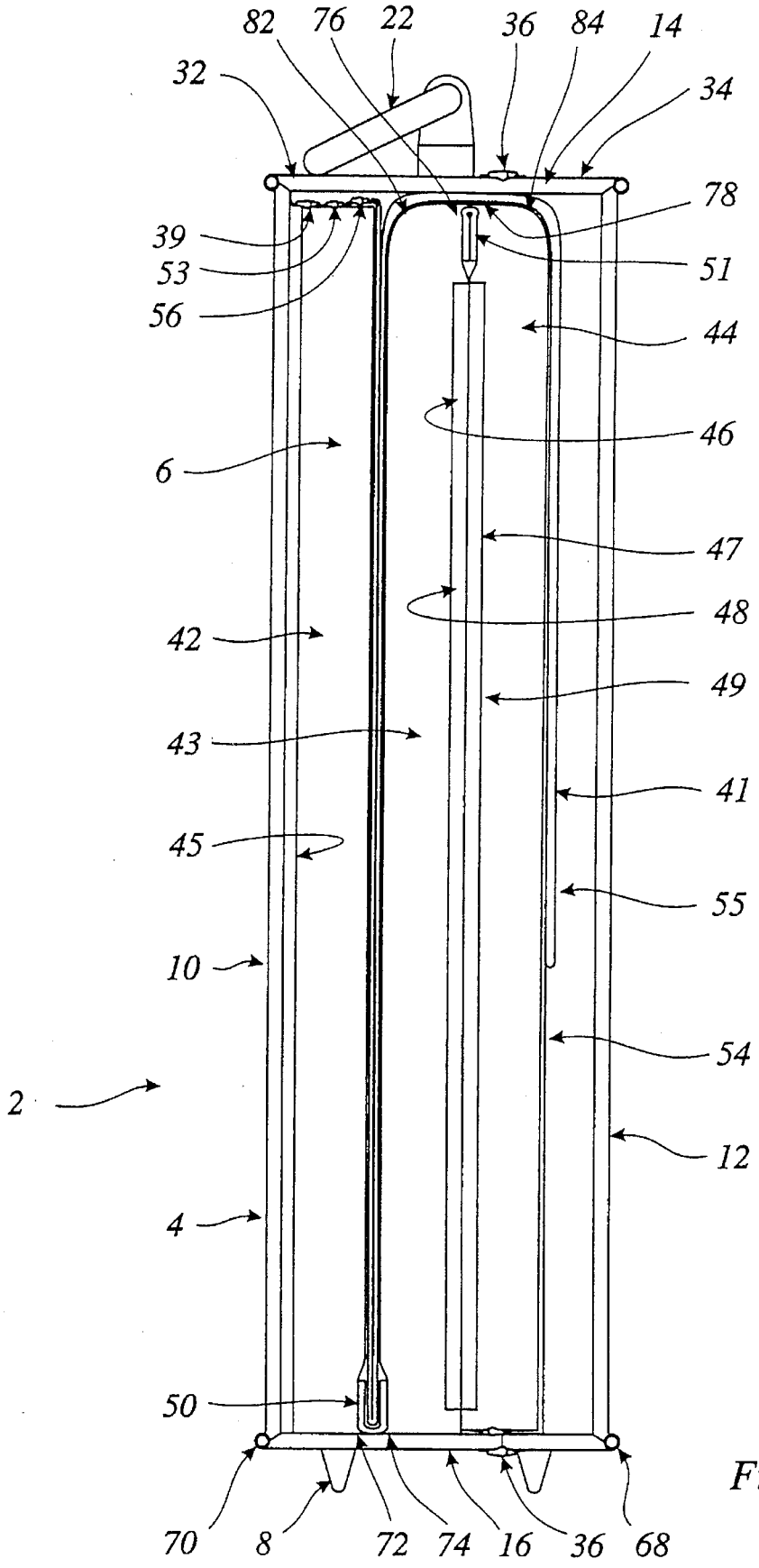
FIG. 2 is a cross-sectional view of the self-contained folding bed of FIG. 1.

As shown in cross section in FIG. 2, the ground covering and foldable cushioned bedding assembly 6 is detachably joined to casing 4 by a zipper 39, near the foot of cushioned bedding assembly 6 close to the juncture of first main panel 10 and top face 14. As shown in FIG. 4 the internally stored ground covering and foldable, cushioned bedding assembly 6 comprises a foldable cushioning assembly, or pallet 40, and a bed clothing assembly 41. The foldable cushioning assembly, or pallet 40, comprises three resilient compressible elements, or cushions, 42, 43 and 44, each of which comprises a first ground wall, or lower surface 45, 46 or 47 respectively. Affixed to each of lower surfaces 46 and 47 are integral puncture resistant panels 48 and 49, respectively. A first material hinge 50 is intermediate, and has one wing affixed to each of, cushions 42 and 43, and a second material hinge 51 is intermediate, and has one wing affixed to each of, cushions 43 and 44 to facilitate folding of foldable cushioned bedding assembly 6 to its first, or storage position. Pallet 40 also comprises a fabric liner 52 which envelops all three resilient cushioning elements.

Cushioned bedding assembly 6 comprises a zipper 53, with upper and lower halves **53*a* and 53*b*, used to affix bed clothing assembly 41 detachably to pallet 40. Bed clothing assembly 41 comprises a first, bottom, undersheet, or lowersheet 54, a second, top, cover, uppersheet or upper blanket 55, and ha cover zipper 56 having an upper half 56*a* and a lower half 56*b* for detachably affixing upper blanket 55 to lowersheet 54. Other features may include an integral pillow 64**, a toiletries pouch (not shown), and a spare clothing pouch (not shown).

In the preferred embodiment shown external casing 4 comprises soft sided collapsible covering materials, but other more rigid materials may be used with suitable modifications as will be described. The main elements of casing 4 may be a single ply or several plies of any suitable treated liquid absorption resistant fabric known to those skilled in the art, or the casing may comprise panels of a sandwich construction in which a more rigid material is sewn within two layers of a cover. In each case it is advantageous that the external material be resistant to water absorption and that the skin itself or such internal stiffening member as may be chosen be resistant to punctures. Many such materials are known and used, for example, in protective clothing for contact sports, and may include woven aramid fabrics.

The cover formed by casing 4 is like that of a suitcase. By analogy to a suitcase, zipper 36 demarcates a boundary between the shallow lid, and the deep body of the case. Casing 4 is movable from a first, closed or storage position to a second open position, and in said second, open position the portable folded cushioned bedding assembly 6 may be pulled by its distal end and extended for sleeping. The shallow lid is formed from second main panel 12 which has a peripheral piping seam 68 comprising a resilient piping core which tends to stretch first main panel 12 flat, and from which depend bottom face 16 and second portions 26, 34, and 30 of faces 18, 14, and 20 respectively to a distal margin to which zipper half **36*b* is sewn. Similarly the deep body of the case is formed from first main panel 10 which has a second peripheral piping seam 70 of similar construction to seam 68, to which bottom face 16 is attached, whether with a rigid hinge or by a seam of cloth material. First portions 24, 32, and 28 of faces 18, 14, and 20 form a continuous band of material and extend, ideally, perpendicularly from seam 70 toward second main face 12, terminating at a distal margin to which zipper half 36*a* is sewn. In the first, closed or storage position second main panel 12 is ideally substantially parallel to, and in spaced apart relation to, first main panel 10**. In practice the orientation of the faces of a soft sided suitcase is determined by how much material is placed within it.

To open the self-contained portable bed, or bed in a suitcase, 2, one releases zipper 36 and displaces the external side of first main panel 10 to lie substantially flatly, be it upon the ground, floor, or other suitable surface, substantially co-planar with the external side of second main panel 12. In the soft sided embodiment of the present invention, bottom face 16, top face 14 and side faces 18 and 20, or the respective portions thereof, are intended to collapse underneath or alongside the cushioned bedding assembly 6.

Figure 3:
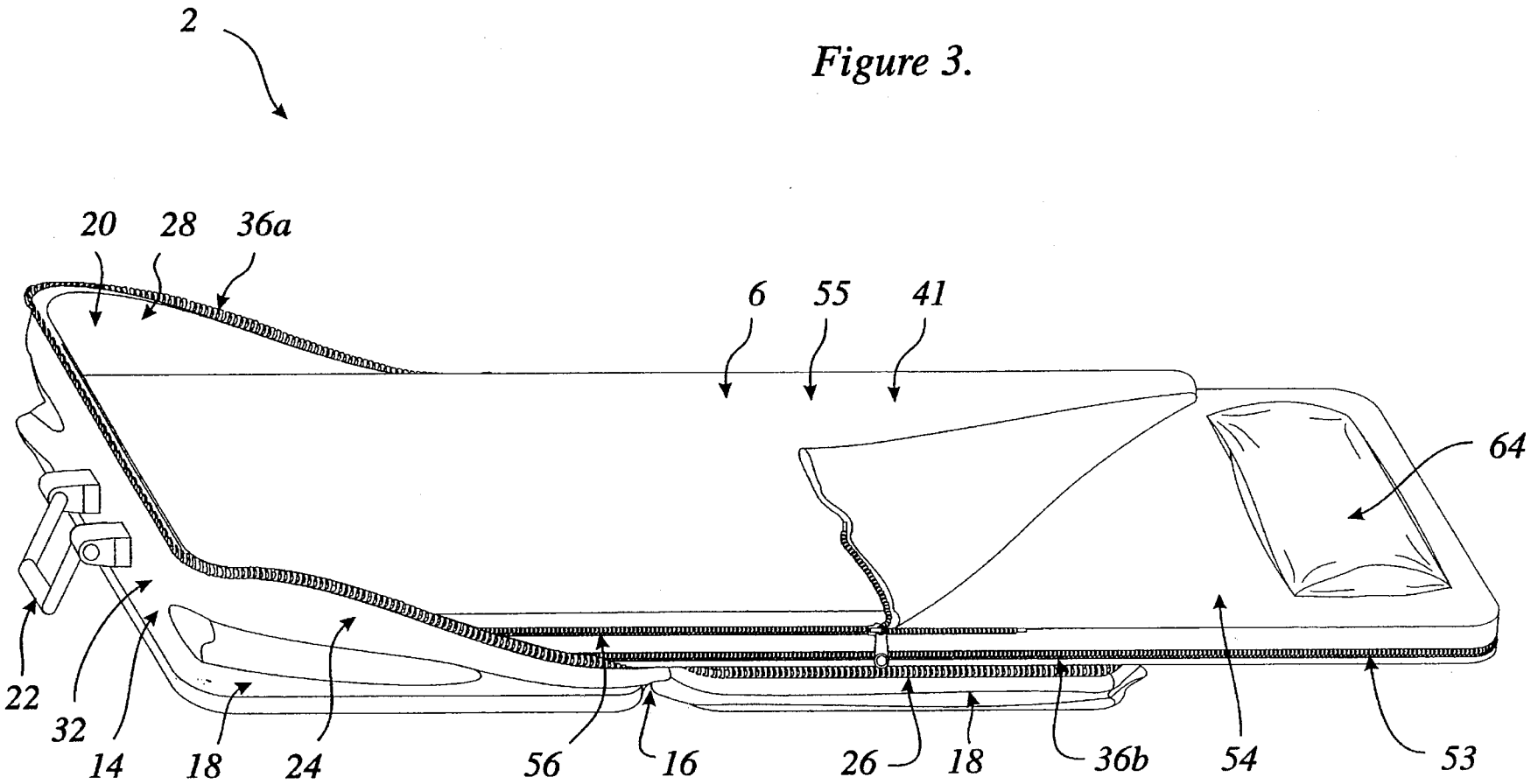
FIG. 3 is a general arrangement of the self contained folding portable sleeping unit of FIG. 1 in its extended state, ready for use.

FIG. 3 shows the self contained portable bed, or the portable bed in a suitcase, in its second, extended position suitable for reclining a body thereupon. First cushion portion 42 is connected along a vertex 72 to first material hinge 50, which is in turn fastened along a vertex 74 of second cushion 43, thereby permitting second cushion 43 to fold about material hinge 50 to either its closed position corresponding to the first, storage position shown in FIGS. 1 and 2, or to a second, open position as shown in FIGS. 3, 4 and 5. Similarly, second material hinge 51 is mounted along vertex 76 of second cushion 43, vertex 76 being the parallel spaced, diagonally opposite vertex of second cushion 43 from vertex 74. Second material hinge 51 is also mounted to vertex 78 of third cushion 44 such that third cushion 44 is pivotally movable with respect to second cushion 42 from a first position corresponding to the first, storage position shown in FIGS. 1 and 2, to a second position corresponding to the second, extended position shown in FIGS. 3, 4 and 5.

Resilient compressible elements, or cushions, 42, 43, and 44 may be constant density foam monoliths or they may have two or more layers of cushioning material of varying density and compressibility. In the embodiment of FIG. **4*a* each panel is nominally 28 inches wide (i.e., wide in the direction of width of the bed as extended) 26 inches long (with reference to the longitudinal axis of the bed as extended) and 2.5 inches thick. Each puncture resistant panel 48 or 49 is 27 inches wide by 25 inches long such that when centered on faces 46 and 47, as the case may be, those faces extend beyond the periphery of the puncture resistant panels one half inch on all sides. In the first, storage position, puncture resistant panels 48 and 49 are disposed in opposed, facing contact intermediate resilient compressible elements, or cushions 43 and 44, and consequently intermediate first and second main panels 10 and 12. As such no sharp edges of panels 48 and 49** protrude to scratch or puncture, for example, automobile upholstery. Rather there is cushioning material surrounding them to facilitate, again for example, cramming the bed in a suitcase behind a truck seat or on top of a transverse spare wheel well in a car trunk ready for use when needed.

When deployed in the second, extended position resilient compressible elements, or cushions 42, 43, and 44 lie side by side within liner 52 to form pallet 40 upon which a body may be reposed.

Figure 4A:
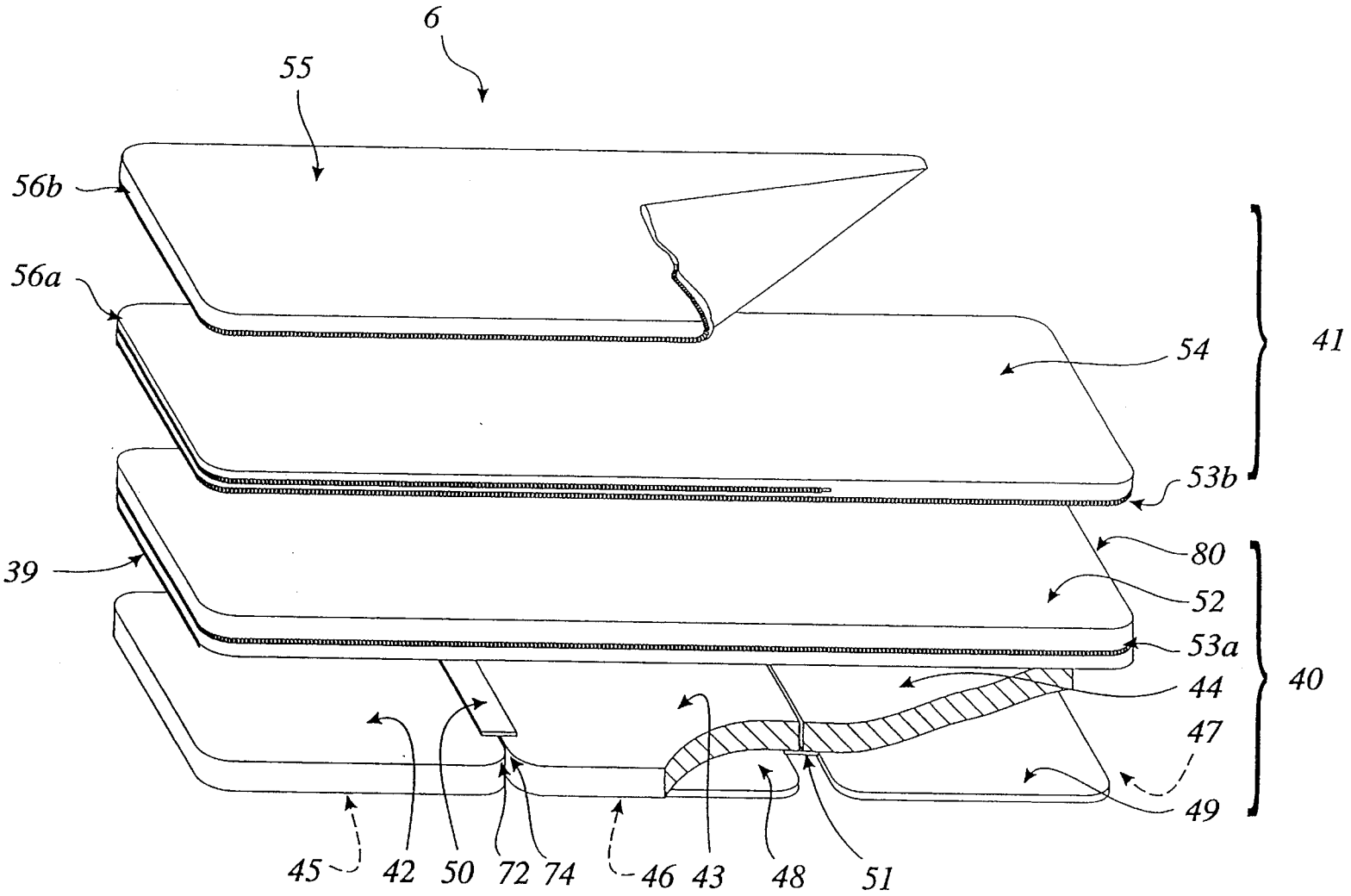
FIG. 4 comprises FIG. 4*a*, an exploded view of the cushioned bedding assembly the portable folding bed of FIG. 1, and FIG. 4*b*, a corresponding view of an alternative embodiment of the self-contained portable bed of FIG. 1.
Figure 5C:
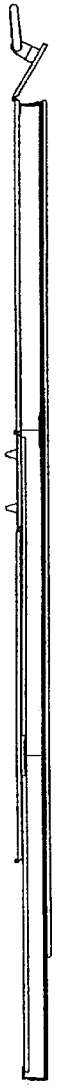
FIGS. 5*a*, 5*b* and 5*c*, is a series of views of an alternate, at least partially stiff sided, embodiment of the self-contained portable folding bed of FIG. 1.

Pallet 40 has a periphery 80. In the embodiment of FIG. 4*a* lower sheet 54 extends across all of the upper surface of pallet 40, and, in a manner similar to that of a fitted sheet, extends downward to cover at least a portion of the side-walls, or periphery 80, of pallet 40. Zipper half 53*b*' extends along one long side of pallet 40, around the distal, extended end of pallet 40, back along the opposite long side, and may completely surround pallet 40 by returning across the foot end thereof. The other zipper half, 53*a*, is correspondingly sewn, glued or affixed to lower sheet 54. Other means could be employed for this purpose, such as commonly used hook and eye patches, or elastic-hemmed fitted sheets. Lower sheet 54 may be reinforced, or made of double thickness around its periphery to resist tearing during folding. As folded lower sheet 54 will tend to compress a vertex 82 of cushion 43 and a vertex 84 of cushion 44. There will be a resultant stress in lower sheet 54, and in liner 52. This stress is taken up in lower sheet 54, liner 52, and in elastic deformation of cushions 43 and 44. Therefore, a reinforcement may be sewn on the underside of lower sheet 54, or within liner 52, near the juncture of second cushion 43 with third cushion 44 to resist this stress as folded in the first, storage position. When lower sheet 54 becomes soiled it may easily be removed and washed.

At the foot of pallet 40 one finds zipper 39. Zipper 39 need not be attached directly to pallet 40, but could alternatively be attached to an element of bed clothing assembly 41. Folding cushioning assembly 6 need not strictly be attached to casing 4, although it is convenient to do so, particularly since it maintains casing 4 beneath at least a portion of pallet 40 during use, thus providing more effective ground covering protection for pallet 40. Zipper 39 thereby locates foldable cushioned bed assembly 6 with respect to casing 4.

Second, upper blanket 55 is provided to cover lower sheet 54. It may be a single sheet, a flannel sheet, a woollen blanket, a quilt, a comforter, or, as in the preferred embodiment, a half sleeping-bag bed cover. It may be convenient for upper blanket 55 not to extend the full length of pallet 40, but rather to be truncated, as shown, to leave a sleeping person's head exposed. Upper blanket 55 has a periphery 86. Zipper 56 detachably joins upper blanket 55 to lower sheet 54, commencing near the distal end of one longitudinal side of upper blanket 114, extending to, and across the foot thereof, and back outward along the opposite longitudinal side thereof to terminate once again at or near the distal end of upper blanket 55 as shown.

It will be apparent to those skilled in the art that a self contained, folding, portable bed, alternately termed a bed in a suitcase, could be formed using a number of folds which fold in the same direction, as opposed to the accordion folding operation of the preferred embodiment. Further, one may be willing to fold a resilient foam monolith, for example a futon, without the use of hinges, or to fold such a monolith as a roll, provided such variations may still be contained within a suitcase-like enclosure.

Further, in an alternative embodiment one may wish to form the casing at least in part, of stiff-sided members, possibly resilient, fiberglass reinforced panels. In that instance bottom face 16 may be substantially rigid. This rigidity may be accommodated by disposing zipper 36 as shown in FIG. 5*a* whereby zipper ends 88 and 90 are located at or near the juncture of either first major panel 10 and bottom face 16 or near the juncture of second major panel 12 and bottom face 16, thus allowing first major face 10, bottom face 16, and second major face 12 to form an extended rectangular, relatively stiff puncture resistant layer underlying a substantial portion of bedding assembly 6.

Figure 5B:
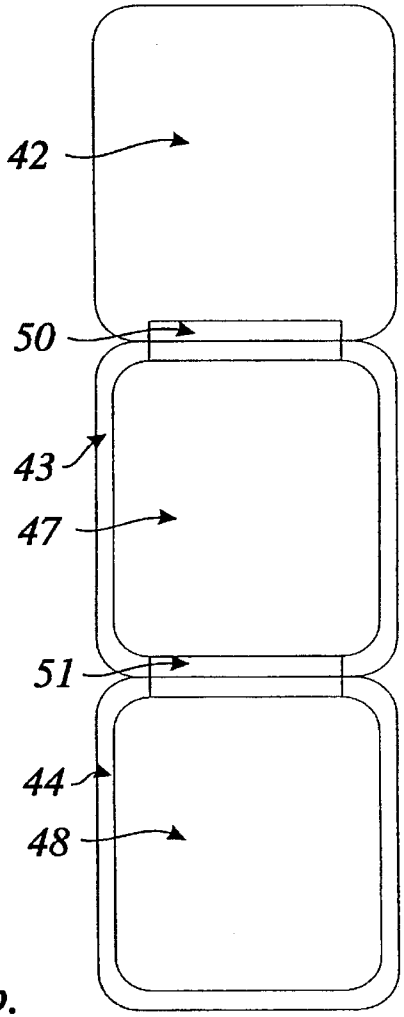
Figure 5A:
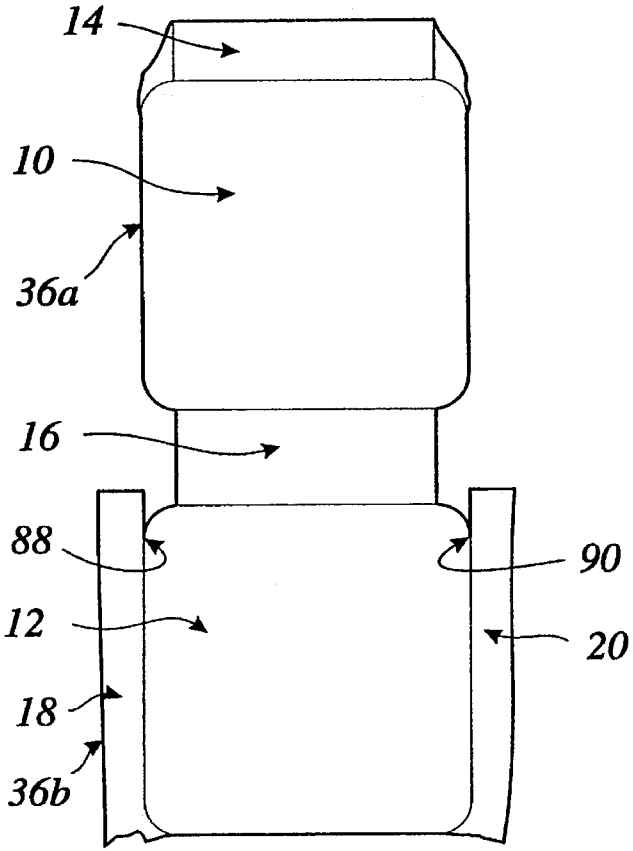

As illustrated in FIG. 5*b*, puncture resistant panels 48 and 47 each underlie a portion of pallet 40, being substantially all of second and third cushions 43 and 44 respectively. As shown in the cross section of FIG. 5*c*, puncture resistant panels 48 and 49 may overlap the relatively stiff, puncture resistant layer formed by one or more of first major panel 10, second major panel 12, and bottom face 16 of the alternate, more rigidly sided embodiment. Thereby a relatively rigid, puncture resistant layer would underlie substantially all of bedding assembly 6.

The use of a suitcase form, rather than that of a back-pack or rucksack, permits a relatively large bed to be formed from a small number of folds. The overall height and width dimensions of the preferred embodiment are 30 inches wide by 27½ inches high, yielding a bed 78 inches long. For those who prefer an even larger bed one may easily increase the dimensions. Since the invention herein is not primarily intended for back-packing and camping in the bush, but rather as a bed for use on short notice, the suitcase form is not unduly cumbersome.

Figure 4B:
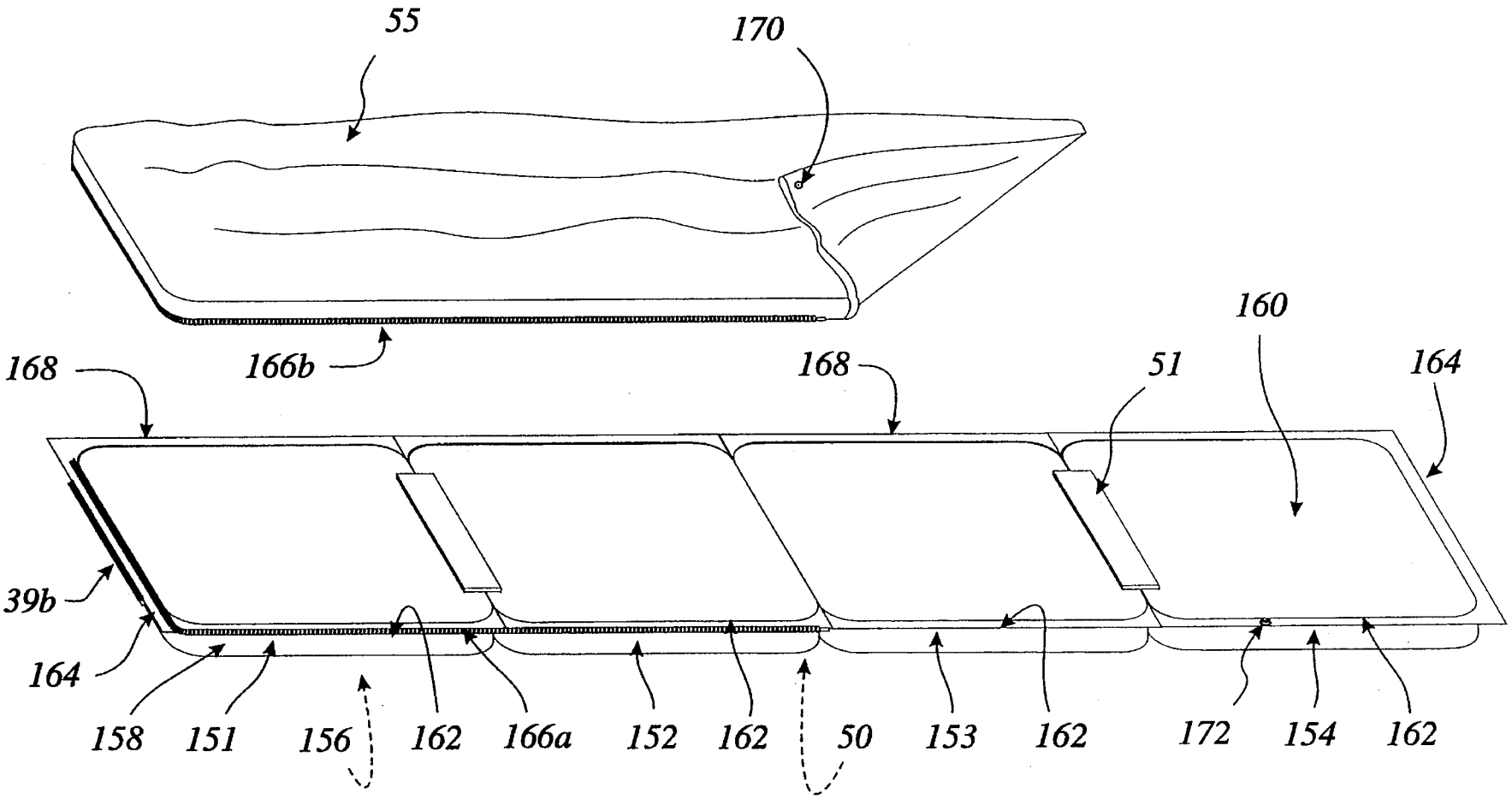

FIG. 4*b* illustrates features of another preferred embodiment of the invention. The self-contained portable folding bed herein described need not consist of three panels, and those panels need not be suited to the nominal 30 inch by 27½ inch suitcases dimensions. For example, the self-contained portable folding bed of the second preferred embodiment has four panels 19 inches in length by 28 inches in width, each cushion being 2 inches in thickness, rather than 2½. In this way a smaller suitcase enclosure may be used, which may be more convenient.

FIG. 4*b* also illustrates a more simplified form of construction. Liner 52 and lower sheet 54 have been eliminated. In this embodiment there are 4 cushion assemblies, 151, 152, 153, and 154 respectively. Each of these cushion assemblies is enveloped in a linen casing comprising a lower panel 156 (not visible in the illustration) a circumferential side panel 158, and an upper panel 160. Side panel 158 is sewn circumferentially about the chosen foam interior intermediate, and ideally perpendicular to, lower panel 156 and upper panel 160. Upper panel 160 may extend beyond the periphery enclosed by side panel 158 to leave a near side verge, or border 162, and an end verge 164 and far side verges 168 as may be required. A first zipper half 39 is sewn to end verge 164 of cushion assembly 151 for fastening to the casing 6 in the previously described manner. A zipper 166 comprises a first half 166*a* and a second half 166*b*. First zipper half 166*a* is sewn continuously along the aligned side verges 162 of first cushion assembly 151 and second cushion assembly 152. Fabric hinges 50 and 51 (not visible in FIG. 4*b*) are used as before to link adjacent cushion assemblies.

Zipper 166 does not extend past the line of abutment of cushion assembly 152 with cushion assembly 153. This obviates the need for any reinforcing material or the compression of any cushioning members during reverse folding. Upper blanket 55 is provided with a snap fastener 170 suitable for mating with a corresponding mating snap 172 located within side verge 162 of cushioning assembly 154. A series of such snaps, or alternate fastening means may be used without departing from the nature of the invention.

In the alternative embodiment of FIG. 4*b* zipper 166 extends only across end verge 164 of cushion assembly 151 and side verges 162 of cushion assemblies 151 and 152. It does not extend along the far side verges 168. Rather upper blanket 55 is sewn along a continuous seam over that length. Note also that the fit of upper blanket 55 is baggy or loose to permit one to more easily extend one's toes upwardly thereunder.

The features of one embodiment may be adapted for use with another embodiment. For example the verges used in the embodiment of FIG. 4*b* could as easily be used in the embodiment of FIG. 4*a*. Similarly any reasonable number of panels used, typically 2, 3, or 4, and the hinges employed may be detachable in some cases either to facilitate washing or if a smaller number of panels is suitable for a smaller person or child.

The method of deployment of any embodiment of the present invention is simple. It consists of three steps 1) releasing zipper 36, 2) extending bedding assembly 6 to its second, extended position, merely by pulling the distal, or head end of the bed outward, and 3) lying down upon the bed as so extended. The fourth step, of introducing one's body between upper blanket 55 and lower sheet 54 is optional depending on the ambient temperature. There are no complicated frames to be erected, and: no puncturable membranes to be filled with air.

While advantageous embodiments have been described to illustrate the bed in a suitcase, or the self-contained portable bed, it will be understood by those skilled in the art that various changes and modifications can be made therein without departing from the scope of the present invention as defined in the appended claims.

I claim:

1. A portable bed in a suitcase, comprising: a casing that may be opened and closed and a cushioning assembly containable within said casing; said cushioning assembly extensible from a first, stored portion within said casing to a second extended position for supporting a reposing body; said cushioning assembly detachably joined to said casing, and extending over said casing in said second extended portion.

2. The portable bed in a suitcase of claim 1 further comprising a bed sheet assembly detachably joined to said cushioning assembly.

3. The portable bed in a suitcase of claim 2 wherein said bed sheet assembly comprises a first sheet detachably mounted to said cushioning assembly and a second blanket detachably mounted to said first sheet.

4. The portable bed in a suitcase of claim 3 wherein said cushioning assembly comprises an upper surface and said first sheet substantially envelops said upper surface.

5. The potable bed in a suitcase of claim 1 wherein said cushioning assembly comprises at least:

a first cushioning element;

a second cushioning element; and a hinge intermediate said cushioning elements.

6. The portable bed in a suitcase of claim 5 wherein said cushioning assembly comprises a third cushioning element aligned with said first and second cushioning elements and a second hinge intermediate said third cushioning element and said second cushioning element.

7. The portable bed in a suitcase of claim 6 wherein said cushioning assembly comprises at least three cushioning elements and two hinges and is accordion foldable.

8. A portable bed in a suitcase comprising: a casing that may be opened and closed and a cushioning assembly containable within said casing; said cushioning assembly extensible from a first, stored position within said casing to a second extended position for supporting a reposing body; said cushioning assembly detachably joined to said casing; a bed sheet assembly detachably joined to said cushioning assembly; said cushioning assembly comprises at least:

a first cushioning element;

a second cushioning element;

a hinge intermediate said cushioning elements; and a third cushioning element aligned with said first and second cushioning elements and a second hinge intermediate said third cushioning element and said second cushioning element; said cushioning assembly being accordian foldable;

wherein at least one of said cushioning elements comprises a puncture resistant panel forming a lower surface thereof in said second position.

9. The portable bed in a suitcase of claim 8 wherein said lower surface formed of said at least one puncture resistant panel is inwardly folded in said first, stored position.

10. A method for using a portable folding bed in a suitcase, wherein said bed is detachably joined to said suitcase, said method comprising:

opening said suitcase;

unfolding said bed over said suitcase; and reposing a body upon said bed.

* * * * *